US006319397B1

(12) United States Patent
Su et al.

(10) Patent No.: US 6,319,397 B1
(45) Date of Patent: Nov. 20, 2001

(54) DRAINING DEVICE ADAPTED TO BE DISPOSED WITHIN A DRAIN PORT

(75) Inventors: Chung-Hsin Su, Ping-Tung Hsien; Yu-Cheng Chang, Kaohsiung, both of (TW)

(73) Assignee: Shu-Yin SUN, Irvine, CA (US)

( * ) Notice: Subject to any disclaimer, the term of this patent is extended or adjusted under 35 U.S.C. 154(b) by 0 days.

(21) Appl. No.: 09/620,670

(22) Filed: Jul. 20, 2000

(51) Int. Cl.[7] ..... E03C 1/29

(52) U.S. Cl. ..... 210/163; 210/164; 210/307; 210/532.1; 4/679

(58) Field of Search ..... 210/163, 164, 210/299, 307, 532.1; 4/679, 681

(56) References Cited

U.S. PATENT DOCUMENTS

| | | | | |
|---|---|---|---|---|
| 270,111 | * | 1/1883 | Pike | 4/679 |
| 417,441 | * | 12/1889 | Reader | 210/164 |
| 1,033,448 | * | 7/1912 | Mueller | 210/163 |
| 1,507,531 | * | 9/1924 | Vavdell | 210/164 |
| 2,432,203 | * | 12/1947 | Miller | 210/532.1 |
| 2,472,322 | * | 6/1949 | Weissman | 210/532.1 |
| 3,042,210 | * | 7/1962 | Hattori | 210/163 |
| 3,516,541 | * | 6/1970 | Hardingham | 210/164 |
| 3,751,734 | * | 8/1973 | Lumadue | 4/679 |
| 4,045,346 | * | 8/1977 | Swashey | 210/164 |
| 5,916,436 | * | 6/1999 | Devure et al. | 210/163 |

* cited by examiner

*Primary Examiner*—Christopher Upton
(74) *Attorney, Agent, or Firm*—Pitney, Hardin, Kipp & Szuch LLP

(57) ABSTRACT

A draining device is disposed within a drain port, which is defined by an upper end of a drain pipe embedded in the ground at an elevation below the ground surface. The draining device includes a tubular base member which has an open upper end, a closed lower end, a bottom wall, and a peripheral wall that extends between the upper and lower ends and that is formed with a plurality of drain openings. A water guiding tube is attached within the base member, and extends into the peripheral wall of the base member. The drain openings of the base member are located around the water guiding tube at an elevation above a lower end of the water guiding tube. The water guiding tube has open upper and lower ends, and is capable of guiding water from the upper end of the base member to the bottom wall of the base member. When water accumulates in a lower end portion of the base member, the water surface thereof is above the lower end of the water guiding tube so as to isolate air in the water guiding tube from air in the drain pipe, thereby preventing insects in the drain pipe from accessing the water guiding tube.

4 Claims, 8 Drawing Sheets

DRAINING DEVICE ADAPTED TO BE DISPOSED WITHIN A DRAIN PORT

BACKGROUND OF THE INVENTION

1. Field of the Invention

The invention relates to a draining device, more particularly to a draining device that is adapted to be disposed within a drain port.

2. Description of the Related Art

Referring to FIGS. 1 and 2, a conventional draining device 1 is shown to include a tubular base member 11, a porous top cover 15, and a bottom lid 14.

As illustrated, the draining device 1 is adapted to be disposed within a drain port, which is defined by an upper end of a drain pipe 13 that is embedded in the ground at an elevation below the ground surface G. The base member 11 is disposed on the upper end of the drain pipe 13, and has an open upper end 111, an open lower end 112, and a peripheral wall 110 that extends between the upper and lower ends 111, 112. The top cover 15 is disposed on the upper end 111 of the base member 11, and has a plurality of drain holes 151 in fluid communication with the upper end of the drain pipe 13. The bottom lid 14 is attached to the lower end 112 of the base member 11 by a pivot 16. A counter weight 17 is connected fixedly to the bottom lid 14 in such a manner that the bottom lid 14 normally closes the lower end 112 of the base member 11. The bottom lid 14 is opened by virtue of downward flow of water through the draining device 1.

Some of the disadvantages of the aforesaid conventional draining device 1 are as follows:

(1) The structure of the draining device 1 is somewhat complicated, because it comprises a relatively large number of components, such as the base member 11, the counter weight 17, the bottom lid 14 and the pivot 16.

(2) In case foul odor is present in the drain pipe 13 and because the bottom lid 14 is unable to hermetically cover the lower end of the peripheral wall 110, the foul odor may permeate through the drain port. In addition, the bottom lid 14 may fall into the drain pipe 13 due to long term exposure of the pivot 16 to water, thereby rendering the upper and lower ends 111,112 of the base member 11 in a constantly open state. Under this condition, insects in the drain pipe 13 may move from below the ground surface (G) via the draining device.

(3) The aforesaid draining device is only suitable for use in a drain port that is formed in the ground surface (G), thereby limiting the utility thereof.

SUMMARY OF THE INVENTION

Therefore, the object of this invention is to provide a draining device adapted to be disposed within a drain port which is defined by a drain pipe embedded in the ground. The draining device is clear of the disadvantages mentioned beforehand.

Accordingly, the draining device of the present invention is adapted to be disposed within a drain port, which is defined by an upper end of a drain pipe embedded in the ground at an elevation below the ground surface. The draining device includes a tubular base member adapted to be disposed on the upper end of the drain pipe, and having an open upper end, a closed lower end, a bottom wall, and a peripheral wall that extends between the upper and lower ends and that is formed with a plurality of drain openings. A water guiding tube is attached within the base member, and extends into the peripheral wall of the base member. The drain openings of the base member are located around the water guiding tube at an elevation above a lower end of the water guiding tube. The water guiding tube has open upper and lower ends, and is adapted to guide water from the upper end of the base member to the bottom wall of the base member. Under such a condition, water that accumulates in the closed lower end of the base member has a water surface level above the lower end of the water guiding tube so as to isolate air in the water guiding tube from air in the drain pipe, thereby preventing odor and insects in the drain pipe from accessing the water guiding tube.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
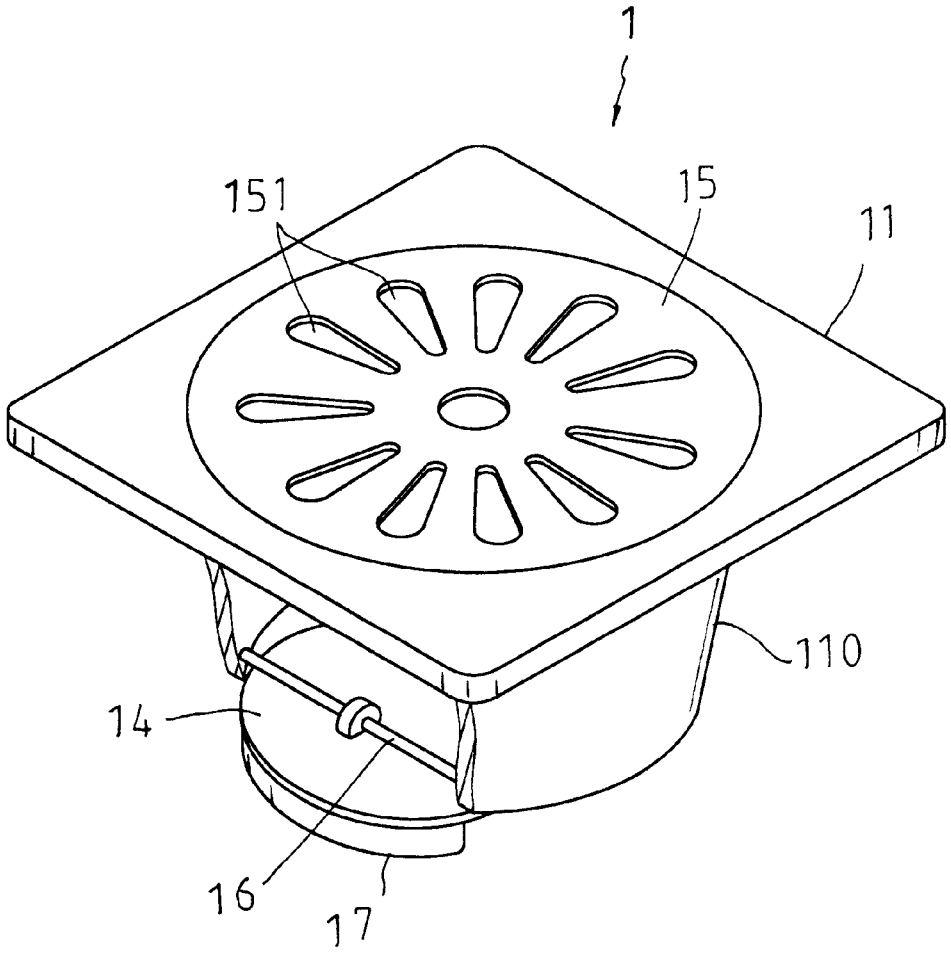
FIG. 1 PRIOR ART
FIG. 1 is a perspective and partly cutaway view of a conventional draining device.
Figure 2:
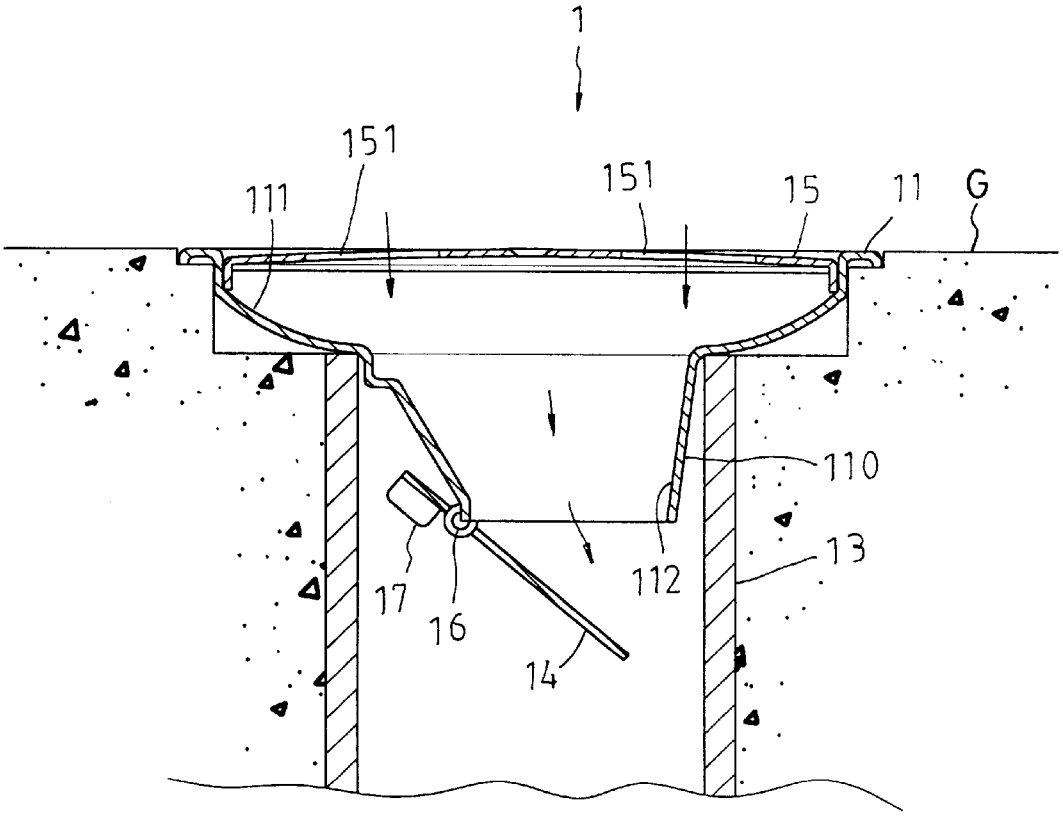
FIG. 2 PRIOR ART
FIG. 2 illustrates how the conventional draining device is mounted within a drain port of a drain pipe that is embedded in the ground.
Figure 3:
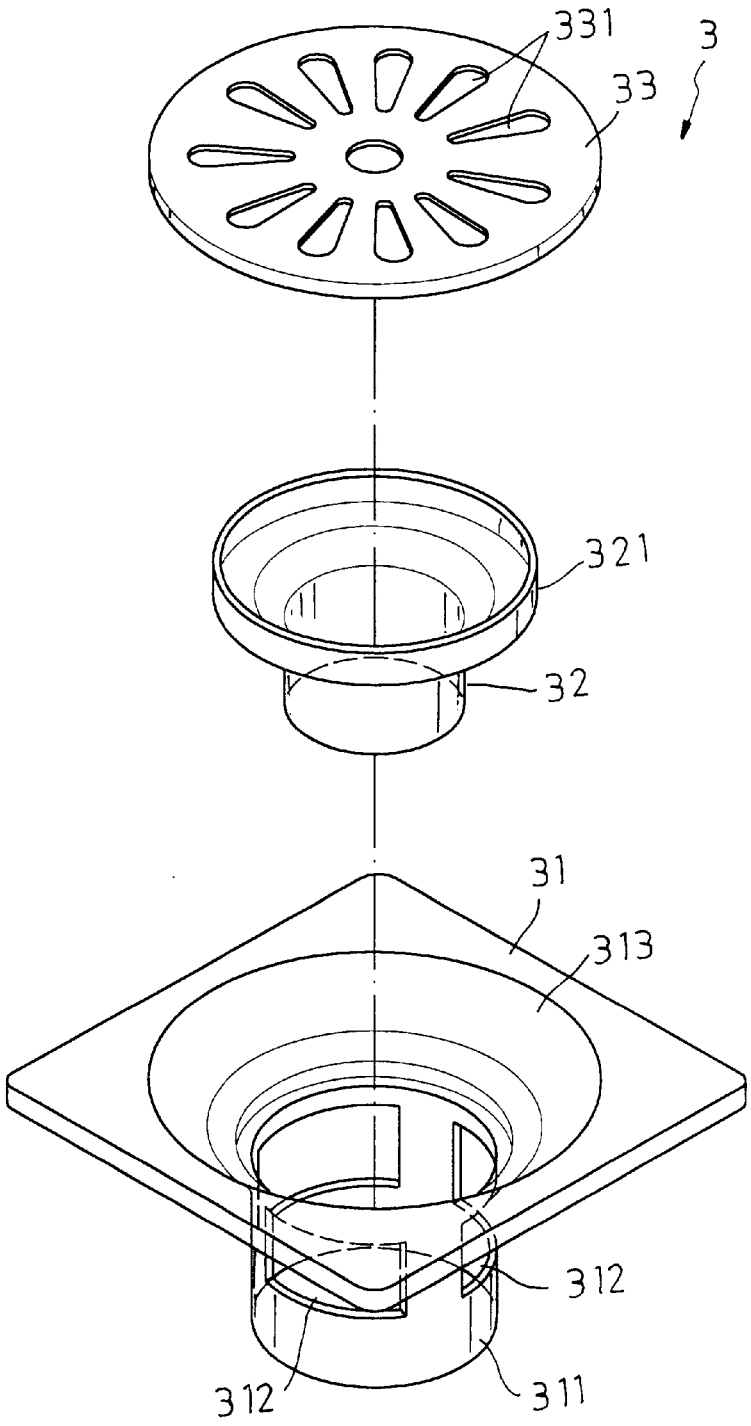
FIG. 3 is an exploded view of a first preferred embodiment of a draining device according to the present invention.
Figure 4:
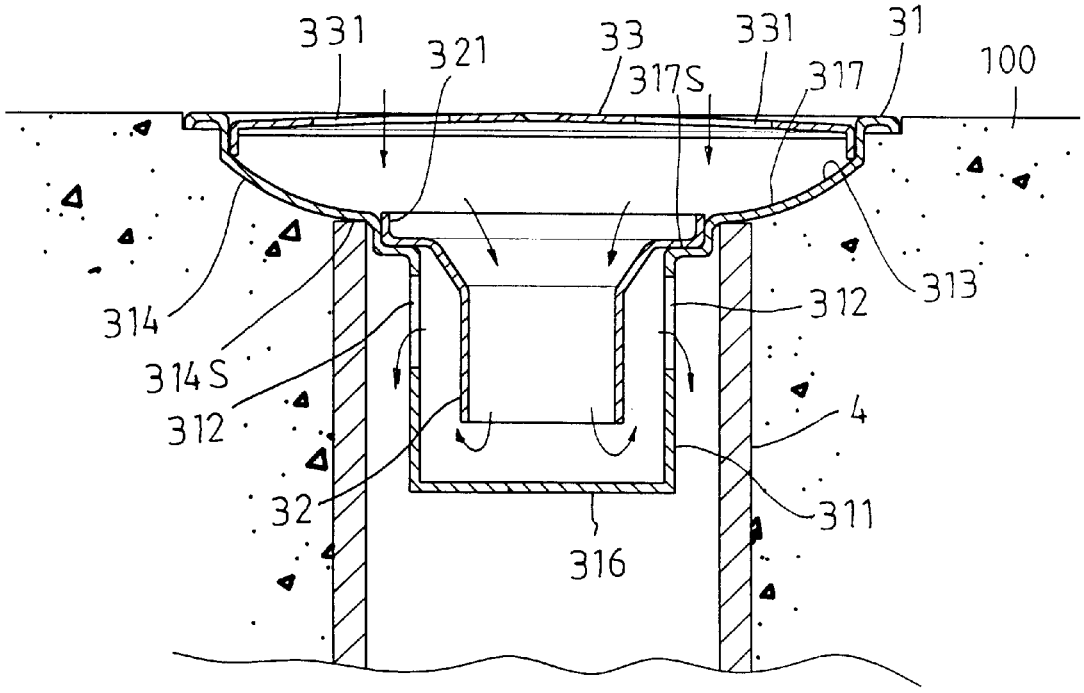
FIG. 4 illustrates how the first preferred embodiment is mounted within a drain port of a drain pipe that is embedded in the ground.

Referring to FIGS. 3 and 4, the first preferred embodiment of a draining device 3 of this invention is shown to include a tubular base member 31, a water guiding tube 32, and a porous top cover 33.

As illustrated, the base member 31 is disposed within a drain port, which is defined by an upper end of a first drain pipe 4 that is embedded in the ground at an elevation below the ground surface 100. The base member 31 has an open upper end 313, a closed lower end 315 with a bottom wall 316, and a peripheral wall 311 that extends between the upper and lower ends 313, 315 and that is formed with a plurality of rectangular drain openings 312.

The water guiding tube 32 is disposed within the base member 31, and extends into the peripheral wall 311 of the base member 31 such that the drain openings 312 of the base member 31 are located around the water guiding tube 32 at an elevation above a lower end of the water guiding tube 32. The water guiding tube 32 has open upper and lower ends, and is adapted to guide water from the upper end 313 of the base member 31 to the bottom wall 316 of the base member 31. Under such a condition, water that accumulates in the closed lower end 315 of the base member 31 has a water surface level which is above the lower end of the water guiding tube 32 so as to isolate air in the water guiding tube 32 from air in the drain pipe 4. In addition, insects in the drain pipe 4 are unable to gain access to the water guiding tube 32 due to the presence of water in the closed lower end 315 of the base member 31.

The base member 31 has an outer wall surface 314, which is formed with an outer shoulder (314S) that abuts against the upper end of the drain pipe 4, and an inner wall surface 317 which is formed with an inner shoulder (317S). The water guiding tube 32 has an upper end portion, which is formed with a shoulder 321 that abuts against the inner shoulder (317S) of the base member 31, thereby positioning the water guiding tube 32 within the base member 31.

The top cover 33 is disposed removably on the upper end 313 of the base member 31, and has a plurality of draining openings 331 in fluid communication with the water guiding tube 32.

Figure 5:
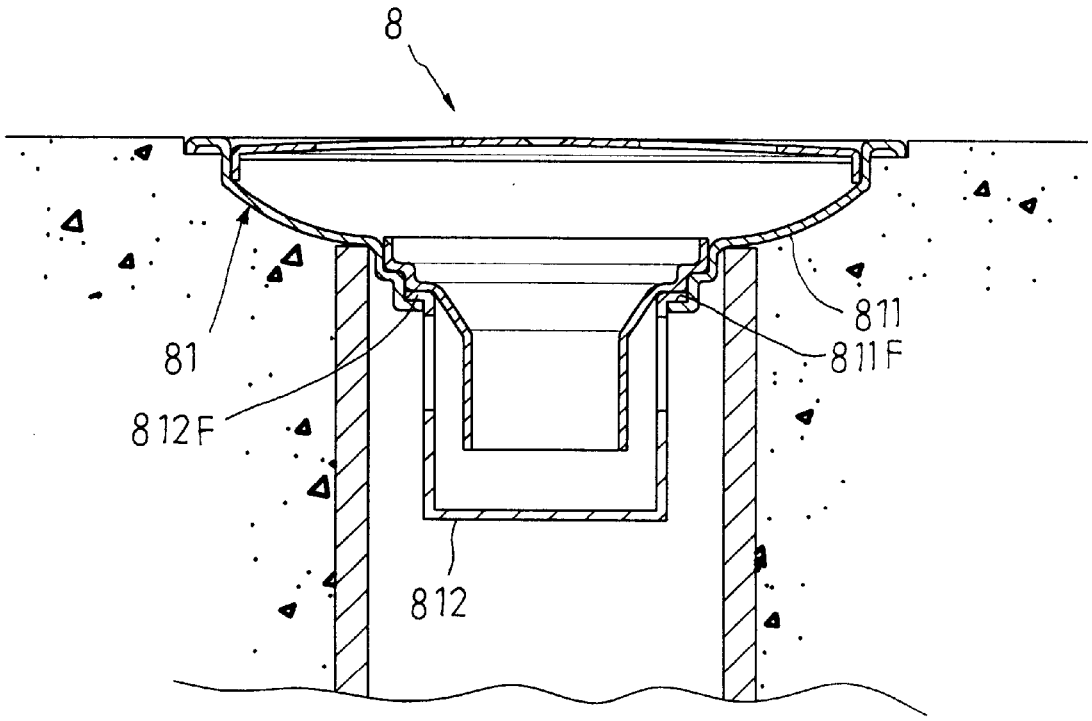
FIG. 5 illustrates how a second preferred embodiment is mounted within a drain port of a drain pipe that is embedded in the ground.

Referring to FIG. 5, a second preferred embodiment 8 of the present invention is shown to have a structure similar to that of the first preferred embodiment, except for the base member 81. As shown, the base member 81 includes an upper tube element 811 that is formed with an inwardly extending flange (811F) at a lower end thereof, and a lower tube element 812 that is formed with an outwardly extending flange (812F) at an upper end thereof. The outwardly extending flange (812F) of the lower tube element 812 abuts against the inwardly extending flange (811F) of the upper tube element 811, thereby positioning the lower tube element 812 on the upper tube element 811.

Figure 6:
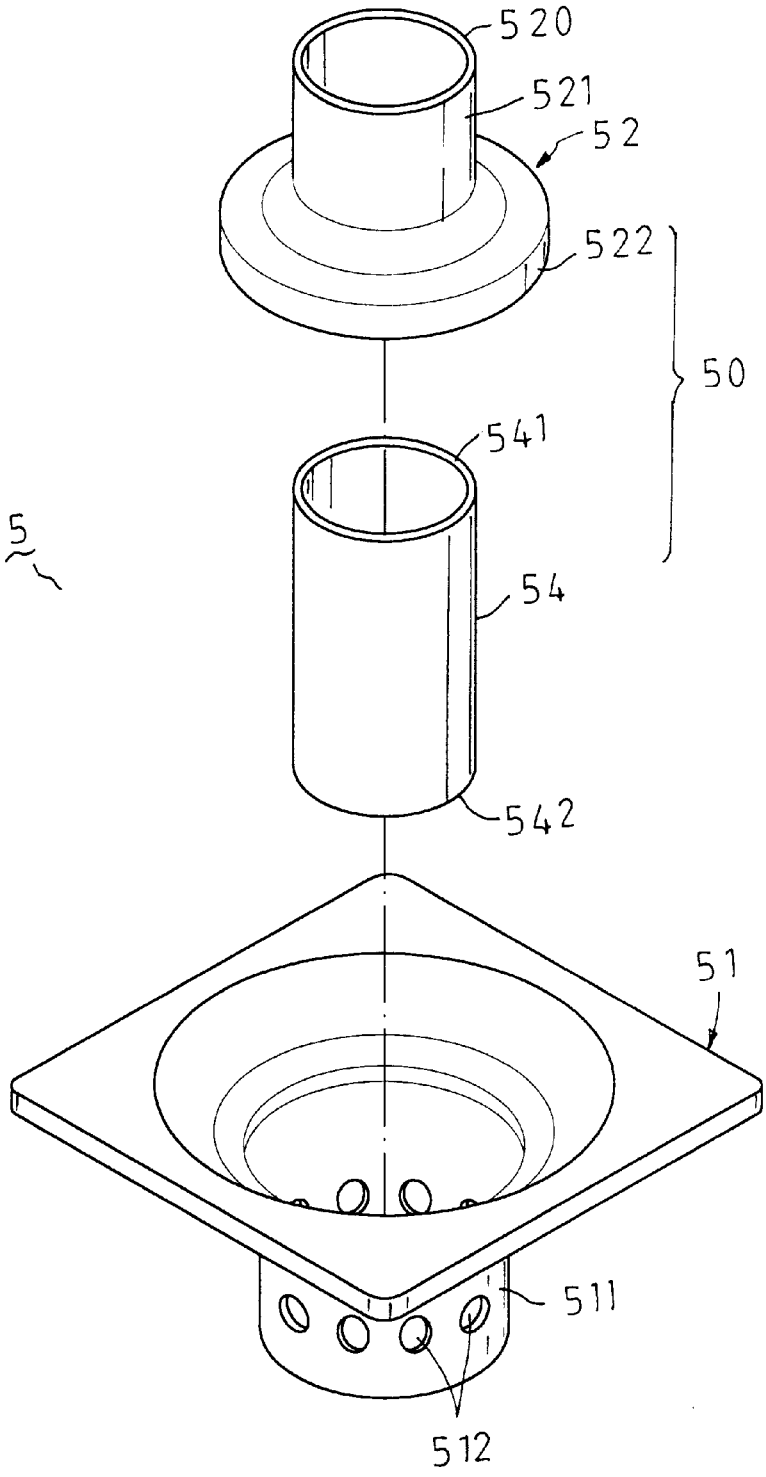
FIG. 6 is an exploded view of a third preferred embodiment of the present invention.
Figure 7:
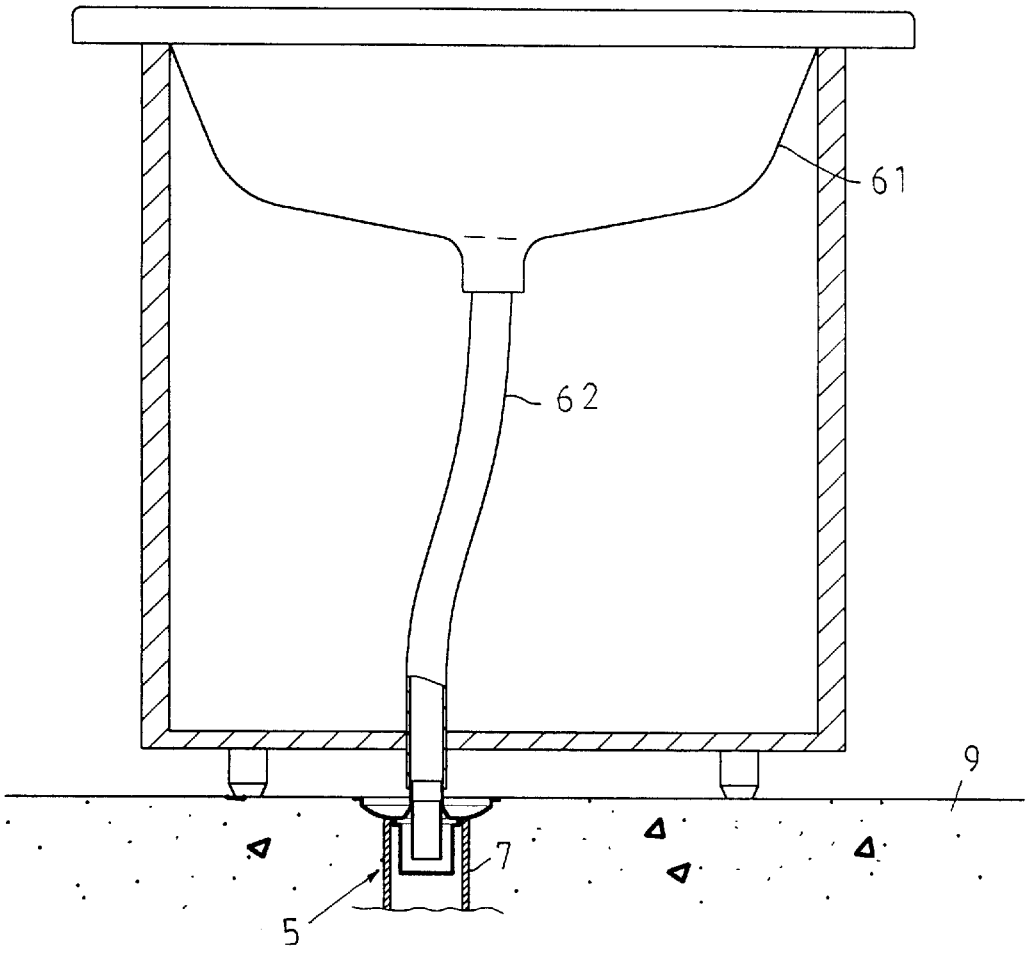
FIG. 7 illustrates how the third preferred embodiment interconnects two drain pipes that are disposed respectively in the ground surface and a sink.
Figure 7A:
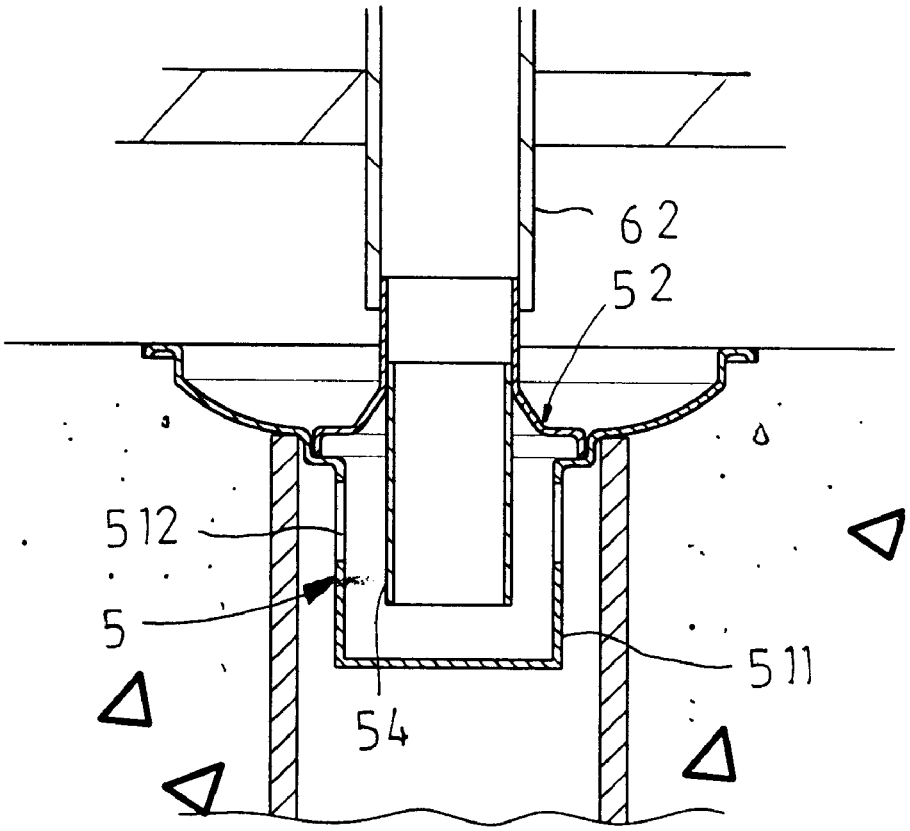
FIG. 7A is an enlarged view of the third preferred embodiment, illustrating how the third preferred embodiment interconnects the drain pipes in the ground and the sink.

Referring to FIGS. 6, 7 and 7A, a third preferred embodiment 5 of the present invention is shown to have a structure similar to that of the first preferred embodiment, except for the water guiding tube 50. As shown, the water guiding tube 50 includes a uniform-diameter lower tube element 54, and an upper tube element 52. The upper tube element 52 has an open upper end 520 press fitted within a lower end of a second drain pipe 62 of a sink 61 (see FIG. 7), a small-diameter upper section 521, and a large-diameter lower section 522, which has a diameter larger than that of the small-diameter upper section 521. The lower tube element 54 has an upper end portion 541 that is press fitted within a lower end portion of the small-diameter upper section 521 of the upper tube element 52. Under this condition, a lower end portion 542 of the lower tube element 54 extends into the peripheral wall 511 of the base member 51 in such a manner that the drain openings 512 of the base member 51 are located around the lower tube element 54 at an elevation above the lower end of the lower tube element 54. The features and objects of the second and third embodiments are the same as those of the first preferred embodiment.

The advantages provided by the draining device of the present invention are as follows:

(1) Since water can accumulate in the closed lower end of the base member, insects in the embedded drain pipe are unable to gain access to the water guiding tube, and foul odor in the drain pipe can be prevented from permeating into the ambient atmosphere.

(2) The draining device of the present invention provides a wider range of use, because the drain pipe of a sink can be connected to the drain port in the ground by the use of the draining device of the present invention.

(3) In case solid waste is trapped in the closed lower end of the base member, the solid waste can be easily and manually removed after removal of the top cover and the water guiding member from the base member, thereby ensuring smooth flow of water through the draining device of the present invention.

With this invention thus explained, it is apparent that numerous modifications and variations can be made without departing from the scope and spirit of this invention. It is therefore intended that this invention be limited only as indicated in the appended claims.

What is claimed is:

1. A draining device adapted to be disposed within a drain port, the drain port being defined by an upper end of a first drain pipe that is embedded in the ground at an elevation below the ground surface, said draining device comprising:

a tubular base member adapted to be disposed on the upper end of the first drain pipe and having an open upper end, a closed lower end, a bottom wall, and a peripheral wall that extends between the upper and lower ends and that is formed with a plurality of drain openings;

a water guiding tube attached within said base member, and extending into said peripheral wall of said base member, said drain openings of said base member being located around said water guiding tube and being at an elevation above a lower end of said water guiding tube, said water guiding tube having open upper and lower ends and being adapted to guide water from said upper end of said base member to said bottom wall of said base member; and said water guiding tube further having an upper tube element having an open upper end that is adapted to be press fitted within a lower end of a second drain pipe, a small-diameter upper section and a large-diameter lower section, which has a diameter larger than that of said small-diameter upper section and a uniform-diameter lower tube element having an open end that is press fitted within a lower end portion of said small-diameter upper section of said upper tube element of said water guiding tube;

whereby, water that accumulates in said closed lower end of said base member has a water surface level that is above said lower end of said water guiding tube so as to isolate air in said water guiding tube from air in the first drain pipe and so as to prevent insects in the first drain pipe from accessing said water guiding tube.

2. The draining device as defined in claim 1, wherein said base member has an outer wall surface, which is formed with an outer shoulder that is adapted to abut against the upper end of the first drain pipe, and an inner wall surface which is formed with an inner shoulder, said water guiding tube having an upper end portion, which is formed with a shoulder that abuts against said inner shoulder of said base member, thereby positioning said water guiding tube within said base member.

3. The draining device as defined in claim 1, wherein said base member includes an upper tube element that is formed with an inwardly extending flange at a lower end thereof, and a lower tube element that is formed with an outwardly extending flange at an upper end thereof, said outwardly extending flange of said lower tube element abutting against said inwardly extending flange of said upper tube element, thereby positioning said lower tube element on said upper tube element.

4. The draining device as defined in claim 1, further comprising a porous top cover disposed removably on said upper end of said base member.

* * * * *